US005730231A

United States Patent [19]

Racodon

[11] Patent Number: 5,730,231

[45] Date of Patent: Mar. 24, 1998

[54] GRIPPING AND SHOCK-ABSORBING DEVICE FOR PERCUSSION TOOLS

[75] Inventor: Gerald Racodon, Saint Etienne, France

[73] Assignee: Societe d'Exploitation des Ets Racodon S.A., France

[21] Appl. No.: 586,850

[22] PCT Filed: May 16, 1995

[86] PCT No.: PCT/FR95/00630

§ 371 Date: Jan. 24, 1996

§ 102(e) Date: Jan. 24, 1996

[87] PCT Pub. No.: WO95/32077

PCT Pub. Date: Nov. 30, 1995

[30] Foreign Application Priority Data

May 24, 1994 [FR] France ..... 94 06639

[51] Int. Cl.[6] ..... B25G 1/01; B25D 3/00

[52] U.S. Cl. ..... 173/162.2; 16/116 R; 16/DIG. 12; 173/162.1; 81/489

[58] Field of Search ..... 173/162.1, 162.2, 173/DIG. 2; 227/147, 116 R, DIG. 12; 81/489

[56] References Cited

U.S. PATENT DOCUMENTS

| | | | |
|---|---|---|---|
| 811,390 | 1/1906 | Foreman | 81/489 |
| 2,144,474 | 1/1939 | Woodman | 16/116 R |
| 2,231,222 | 2/1941 | Rosenheimer, Jr. | 16/116 R |
| 2,278,707 | 4/1942 | Luttgens | 173/132 |
| 3,072,955 | 1/1963 | Mitchell | 16/116 R |
| 3,163,865 | 1/1965 | Zetzer et al. | 227/147 |
| 3,302,673 | 2/1967 | Forsberg | 16/116 R |
| 4,197,611 | 4/1980 | Bell et al. | 16/116 R |
| 4,890,355 | 1/1990 | Schulten | 16/DIG. 12 |

FOREIGN PATENT DOCUMENTS

| | | |
|---|---|---|
| 2106726 | 5/1972 | France . |
| 2374144 | 4/1978 | France . |
| 2431352 | 2/1980 | France . |
| 26 10 663 | 9/1977 | Germany . |
| 93 08 665 | 8/1993 | Germany . |
| 93 07 623 | 9/1993 | Germany . |
| 2185209 | 7/1987 | United Kingdom . |

*Primary Examiner*—Joseph J. Hail, III
*Assistant Examiner*—Jay A. Stelacone
*Attorney, Agent, or Firm*—Wall Marjama & Bilinski

[57] ABSTRACT

Gripping device suitable for percussion tools of the type comprising a sleeve tube made of plastic that fits into the body of the tool, characterised in that it comprises a plastic sleeve tube (1) that is structurally flexible and comprises a plurality of large-diameter annular shapes (1.1) joined to each other by connecting shapes (1.2) of smaller cross-section to define a bellows structure with undulations, and in that, at the location of each ring, an internal circular projection (1.3) is provided that presses against the body of the tool, and in that the sleeve tube has at least one internal collar (1.4) capable of fitting and clipping inside at least one circular groove (2.1) formed on the body of the tool.

6 Claims, 2 Drawing Sheets

GRIPPING AND SHOCK-ABSORBING DEVICE FOR PERCUSSION TOOLS

FIELD OF THE INVENTION

The invention relates to the technical field of tools, especially percussion tools such as drift punches in particular.

BACKGROUND OF THE INVENTION

It is known that handle-shaped devices made of a rigid material can be placed on such hand-held tools in order to facilitate gripping by the user. These handle shapes are made in the form of highly rigid plastic sleeve tubes that are fixed by bonding or other means onto the body of the tool.

Guards made in the form of a flange or bowl having a central opening into which the tool fits and which are mounted on the tool with the aid of lips that fit in a collar or circular groove formed on the body of the tool are also known. The only function of this type of guard is to protect the user's hand.

In practice, the extremely high number of shocks causes vibrations that are uncomfortable to the user.

SUMMARY OF THE INVENTION

The goal of the invention was therefore to design a new device that allows the tool to be gripped properly but damps the vibrations caused by the above-mentioned impact forces.

Another goal was to design a low cost simple device that can be adapted to any cross section of the body of the tool.

These goals and others will be apparent from the following description.

According to a first characteristic, the gripping device that can be adapted for percussion tools is of the type comprising a sleeve tube made of plastic that fits onto the body of the tool and is distinctive in that it comprises a plastic sleeve tube that is structurally flexible and comprises a plurality of large-diameter annular shapes linked to each other by connecting shapes of smaller cross-section that define a bellows structure with undulations and in that, at the location of each ring, an internal circular projection is provided that presses against the body of the tool and in that the sleeve tube has at least one internal collar capable of fitting and clipping inside at least one circular groove formed on the body of the tool.

These characteristics and others will be apparent from the following description.

BRIEF DESCRIPTION OF THE DRAWINGS

The object of the present invention is described, merely by way of example, in the following drawings in which.

Figure 1:
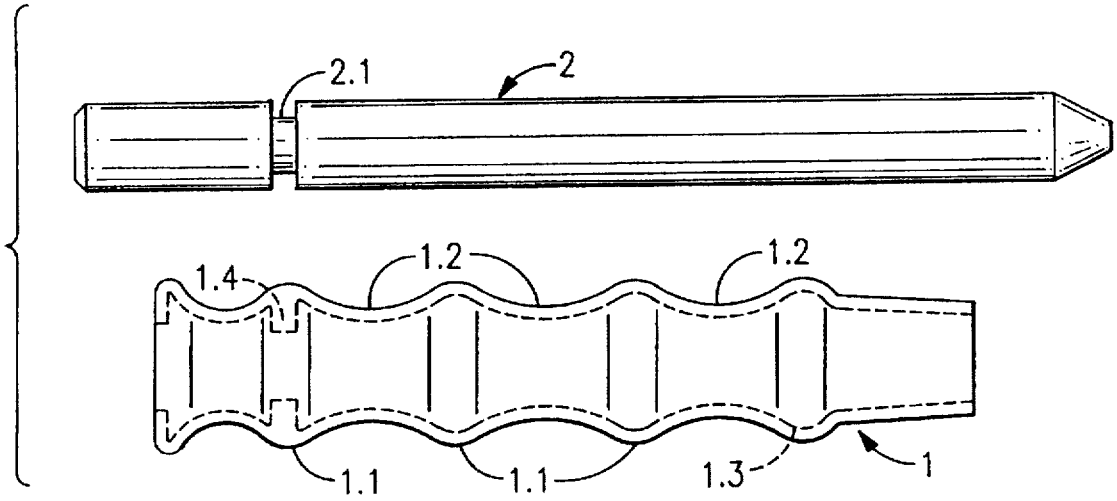
FIG. 1 is a view of the device according to the invention, before assembly, adapted for a percussion tool called a "punch drift".
Figure 3:
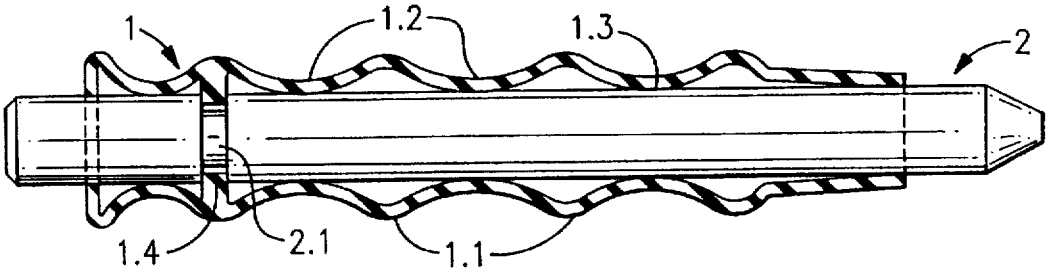
FIG. 3 is a sectional view along line A—A in FIG. 2.
Figure 2:
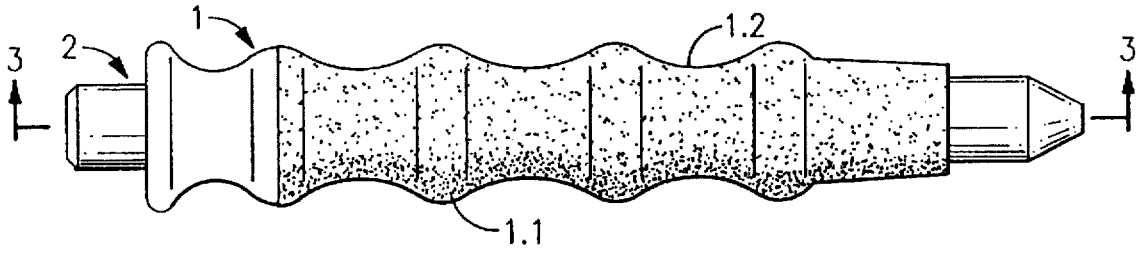
FIG. 2 is a view, after assembly, according to FIG. 1 of the device during operations involving impact.
Figure 4:
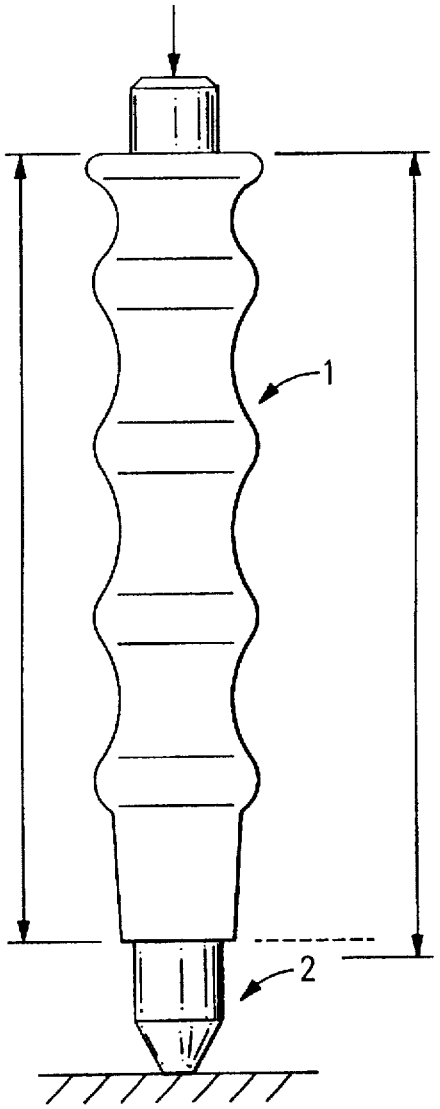
FIGS. 4 and 5 are views showing deformation of the sleeve tube in compression and in extension compared with its non-stressed state.
Figure 5:
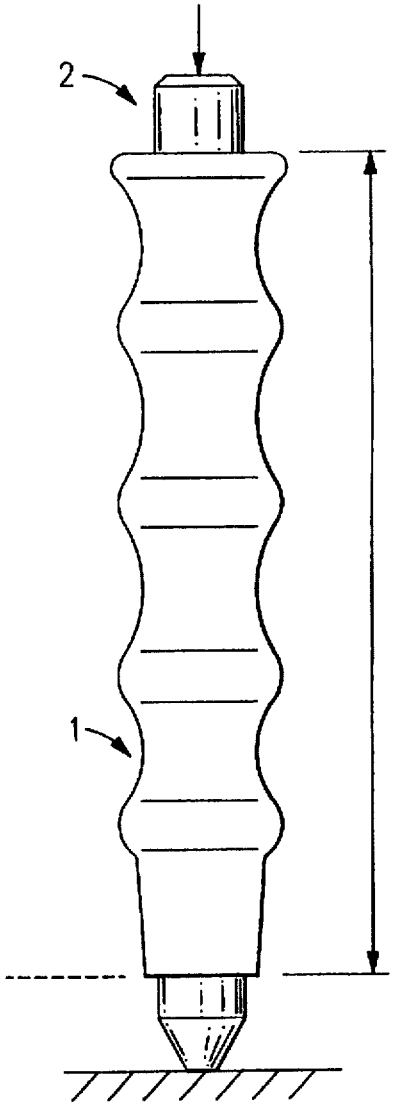

In order that the present invention may more readily be understood, the following description is given, merely by way of example, reference being made to the accompanying drawings.

DETAILED DESCRIPTION OF THE INVENTION

The device according to the invention is designed and produced in the form of a sleeve tube (1) made of plastic that is structurally flexible in order to allow deformation. This sleeve tube is long and comprises, along the sleeve tube, a plurality of large-diameter annular shapes (1.1) linked to each other by connecting shapes (1.2) having a smaller cross-section, which together with the annular portions define a bellows structure with undulations. Each connecting portion (1.2) includes an internal circular projection (1.3) which can press against the body of the tool. These circular projections have a certain depth which, in particular, exceeds the depth of the above-mentioned connecting areas (1.2) the annular portions (1.1) that are not in contact with the body of the tool.

In the upper part of the device, there is provided at least one internal collar (1.4) that can fit and clip inside at least one circular groove (2.1) formed on the body (2) of the tool. This collar forming a lip clips into the groove and thus ensures that the device is properly held.

Thanks to its structure and shape, the device according to the invention makes it possible, by a bellows effect, to absorb shocks due to impact forces by causing either elongation or compression deformation of the sleeve tube and by sliding over the body of the tool.

The top part of the sleeve tube has a shape like a guard to protect the user's hand and has an appropriate diametric cross-section to fulfill such a function. In addition, said top end may have an additional area for connection to the front part of the percussion tool opposite the area where it effectively comes into contact with the workpiece to be struck.

The sleeve tube may have a granite fabric covering along all or part of its length which is obtained by immersion in a suitable bath.

The sleeve tube according to the invention has applications on any percussion tool such as a punch drift or chisel or other tool, can have any diametric cross-section and be of any length.

I claim:

1. A gripping device adaptable for percussion tools, said device comprising:

a tubular sleeve sized for fitting onto a percussion tool body, said sleeve being made of a flexible plastic of substantially uniform thickness, said sleeve further including a plurality of annular portions linked together by connecting portions, each said connecting portion having a defined inwardly curved profile, including an inner contacting surface that presses against the body of the tool when said sleeve is engaged so as to define with said annular portions a bellows-like structure, wherein said tubular sleeve further includes at least one internal collar capable of fitting and clipping inside at least one circular groove formed on the body of a said percussion tool.

2. A device as recited in claim 1 wherein said tubular sleeve includes an extension at one end thereof for protecting a top end of said percussion tool.

3. A device as recited in claim 2, wherein the top end extension of said tubular sleeve includes additional area having a constant diameter and sized for fixing onto the body of the tool, said extension having an inner surface in contact with said tool.

4. A device as recited in claim 1, wherein each connecting portion of said sleeve is capable of deformation in response to impacting force on said tool.

5. A device as recited in claim 1, wherein the tubular sleeve includes a granite fabric covering over all or part of its length.

6. A device as recited in claim 1, wherein said annular portions and said connecting portions; have unequal length dimensions.

* * * * *